US006362703B1

(12) United States Patent
Keesey et al.

(10) Patent No.: US 6,362,703 B1
(45) Date of Patent: Mar. 26, 2002

(54) VERTICAL INTERCONNECT BETWEEN COAXIAL AND RECTANGULAR COAXIAL TRANSMISSION LINE VIA COMPRESSIBLE CENTER CONDUCTORS

(75) Inventors: Timothy D. Keesey, Garden Grove; Clifton Quan, Arcadia; Douglas A. Hubbard, West Hills; David E. Roberts, San Pedro; Chris E. Schutzenberger, Seal Beach; Raymond C. Tugwell, Simi Valley; Gerald A. Cox, Playa Del Rey; Stephen R. Kerner, Culver City, all of CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/482,587

(22) Filed: Jan. 13, 2000

(51) Int. Cl.[7] ..... H01P 1/04
(52) U.S. Cl. ..... 333/33; 333/243; 333/260
(58) Field of Search ..... 333/260, 33, 243

(56) References Cited

U.S. PATENT DOCUMENTS

| | | | | |
|---|---|---|---|---|
| 5,552,752 A | | 9/1996 | Sturdivant et al. | 333/243 |
| 5,570,068 A | * | 10/1996 | Quan | 333/33 |
| 5,618,205 A | * | 4/1997 | Riddle et al. | 439/581 |
| 5,633,615 A | | 5/1997 | Quan | 333/33 |
| 5,668,509 A | | 9/1997 | Hoffmeister et al. | 333/33 |
| 5,675,302 A | | 10/1997 | Howard et al. | 333/243 |
| 5,689,216 A | | 11/1997 | Sturdivant | 333/33 |
| 5,703,599 A | | 12/1997 | Quan et al. | 342/368 |
| 5,982,338 A | * | 11/1999 | Wong | 343/853 |
| 6,236,287 B1 | * | 5/2001 | Quan et al | 333/33 |

FOREIGN PATENT DOCUMENTS

EP 0 901 181 A 3/1999

OTHER PUBLICATIONS

"Integrierte Mikrowellenschaltungen," Reinmut K. Hoffmann, 1983, Springer–Verlag Berlin, Heidelberg, New–York, Berlin, Heidelberg, New–York, Tokyo 1983 XP002164818, pp. 92–93.

Patent Abstracts of Japan, vol. 1996, No. 4, Apr. 30, 1996 & JP 07 336115 A (Nec Corp), Dec. 22, 1995 abstract; figure 1.

Product Data Sheet for CIN ASPE Stacking Connector, Cinch Connectors, 7 pages, 1991.

Product Data Sheet for Gilbert GPO Interconnect System, Gilbert Engineering Co., 4 pages, 1992.

* cited by examiner

*Primary Examiner*—Robert Pascal
*Assistant Examiner*—Stephen E. Jones
(74) *Attorney, Agent, or Firm*—Leonard A. Alkov; Glenn H. Lenzen, Jr.

(57) ABSTRACT

An RF interconnect between a rectangular coaxial transmission line including a coaxial center conductor and a dielectric structure with a rectilinear cross-sectional configuration fitted around the coaxial center conductor and an RF circuit separated from the airline circuit by a separation distance. The RF interconnect includes a compressible conductor structure having an uncompressed length exceeding the separation distance, and a dielectric sleeve structure surrounding at least a portion of the uncompressed length of the compressible conductor structure. The RF interconnect structure is disposed between the rectangular coaxial transmission line and the RF circuit such that the compressible conductor is placed under compression between the substrate and the RF circuit. Examples of the RF circuit include a vertical coaxial transmission line or a grounded coplanar waveguide circuit disposed in parallel with the center conductor of the rectangular coaxial transmission line.

16 Claims, 5 Drawing Sheets

VERTICAL INTERCONNECT BETWEEN COAXIAL AND RECTANGULAR COAXIAL TRANSMISSION LINE VIA COMPRESSIBLE CENTER CONDUCTORS

TECHNICAL FIELD OF THE INVENTION

This invention relates to microwave devices, and more particularly to structures for interconnecting between coaxial or coplanar waveguide transmission line and rectangular coaxial transmission line.

BACKGROUND OF THE INVENTION

A typical technique for providing a vertical RF interconnect with a coaxial line uses hard pins. Hard pin interconnects do not allow for much variation in machine tolerance. Because hard pins rely on solder or epoxies to maintain electrical continuity, visual installation is required, resulting in more variability and less S-Parameter uniformity.

Some interconnect structures employ pin/socket structures. These pin/socket interconnects usually employ sockets which are much larger than the pin they are capturing. This size mismatch may induce reflected RF power in some packaging arrangements. For interconnects to rectangular coaxial transmission line, stripline or similar transmission lines, a pin would have to be soldered onto the surface of the circuit, causing more assembly and repair time.

SUMMARY OF THE INVENTION

The transition from coaxial line or coplanar waveguide transmission line to rectangular coaxial transmission line is made with a compressible center conductor. The compressible center conductor is captured within a dielectric, such as REXOLITE (TM), TEFLON (TM), TPX (TM), and allows for a robust, solderless, vertical interconnect. The center conductor in an exemplary embodiment is a thin, gold plated, metal wire (usually tungsten or beryllium copper), which is wound up into a knitted, wire mesh cylinder. The compressible center conductor is captured within the dielectric in such a way as to form a coaxial transmission line.

The compressibility of the center conductor allows for blindmate, vertical interconnects onto rectangular coaxial transmission lines while maintaining a good, wideband RF connection. The compressible center conductor also maintains a good physical contact without the use of solder or conductive epoxies. The RF interconnect can be applied to either side of the circuit board.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
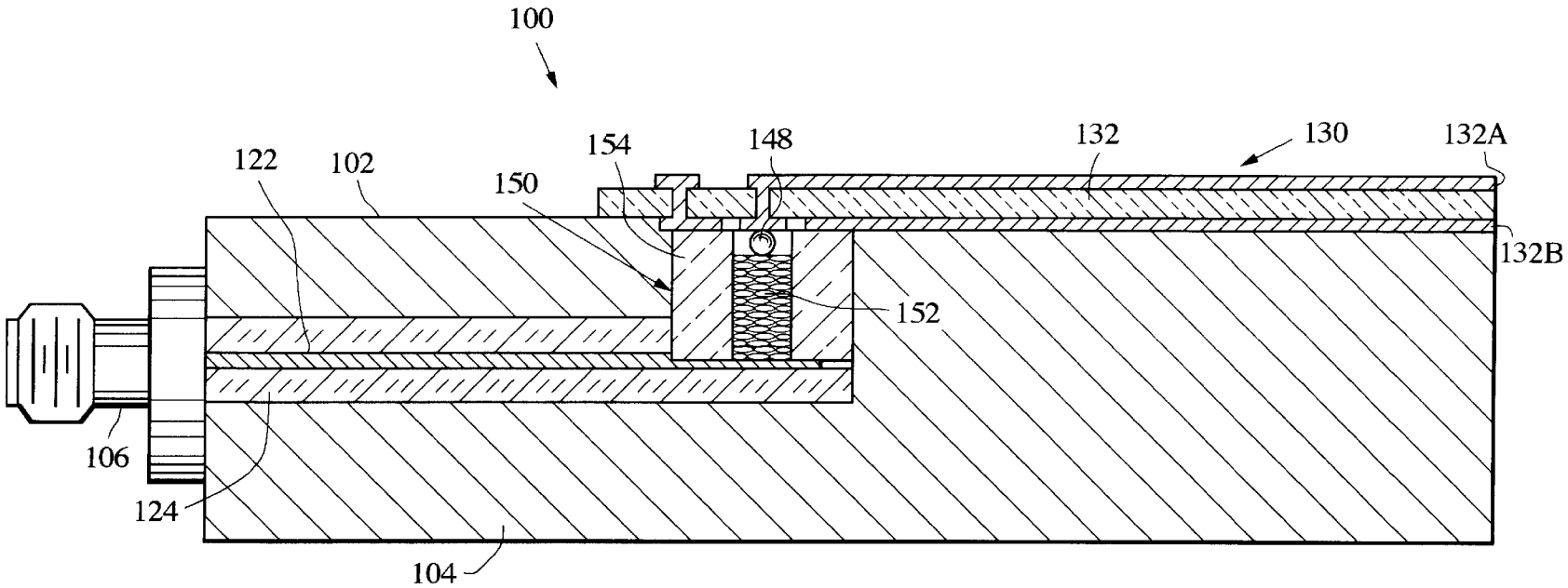
FIG. 1 is an unscaled side cross-sectional diagram of an embodiment of the invention for an interconnect between a rectangular coaxial transmission line and a grounded coplanar waveguide (GCPW) circuit.
Figure 2:
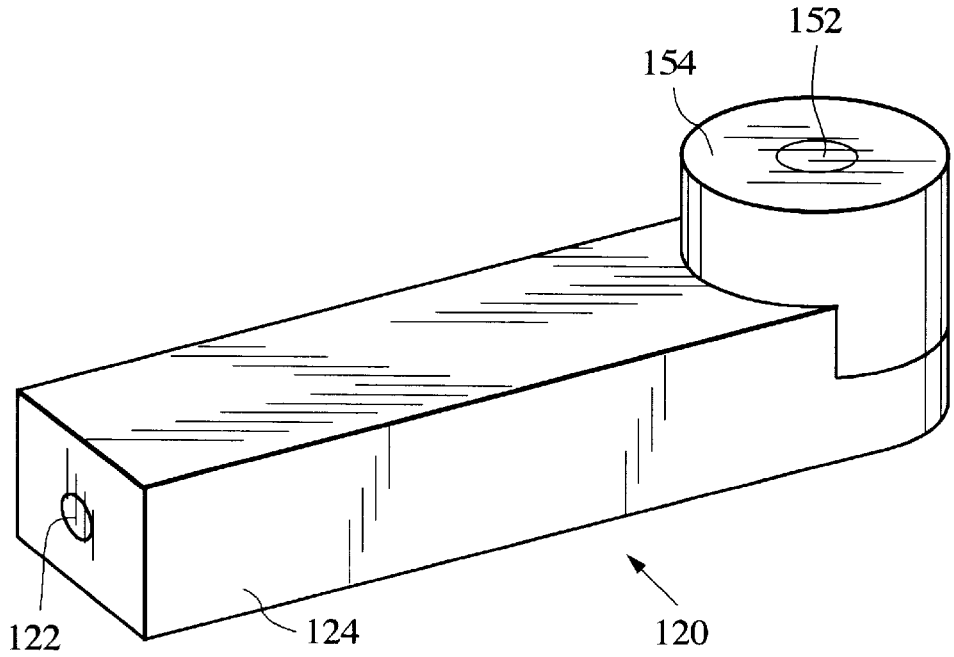
FIG. 2 is an isometric view of the rectangular transmission line and RF interconnect of FIG. 1, without the outer conductive housing.
Figure 3:
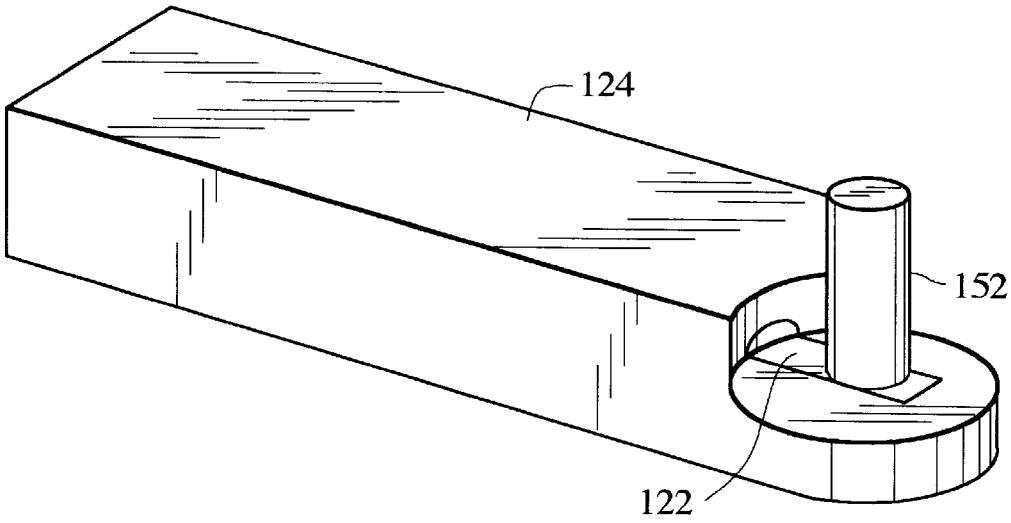
FIG. 3 is an isometric view of the rectangular transmission line of FIG. 1, without the outer conductive housing.

In accordance with aspects of the invention, a vertical interconnect between a rectangular coaxial or "squarax" transmission line and a coaxial or a coplanar waveguide transmission line is made with a compressible center conductor. An exemplary embodiment of the vertical interconnect in an RF circuit 100 for interconnecting to a grounded coplanar waveguide (GCPW) transmission line is illustrated in FIGS. 1–3. A rectangular or squarax transmission line is essentially a coaxial transmission line, but with a rectangular or square shaped dielectric instead of a round cross-sectional configuration. Thus, the rectangular transmission line 120 includes a center conductor 122 having a circular cross-section, and an outer dielectric sleeve 124 fabricated with a square or rectilinear cross-section. In this exemplary embodiment, the center conductor has a diameter of 0.040 inch, and the dielectric sleeve has a width dimension of 0.120 inch and a height dimension of 0.060 inch.

The circuit 100 includes a conductive housing structure comprising an upper metal plate 102 and a lower metal plate 104. The upper and lower plates sandwich the rectangular coaxial line 120, contacting the dielectric sleeve 124. A coaxial connector 106 is attached to the coaxial conductor 124 and to the housing structure.

Figure 4A:
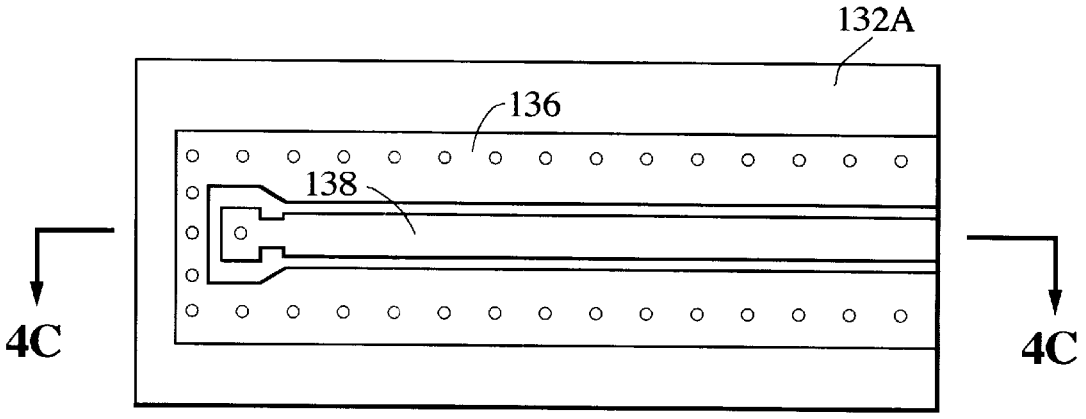
FIG. 4A is an unscaled top view of the GCPW substrate of FIG. 3.
Figure 4B:
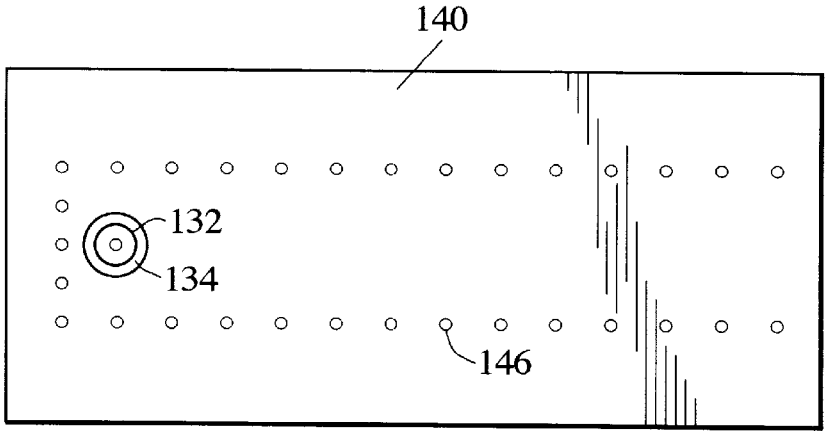
FIG. 4B is an unscaled bottom view of the GCPW substrate.
Figure 4C:
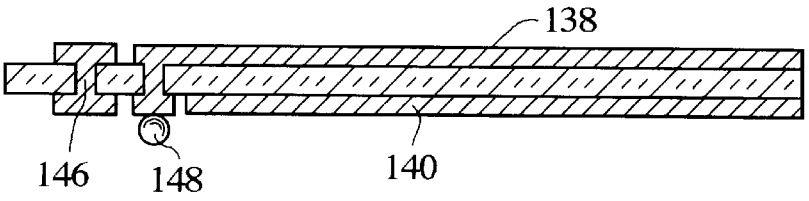
FIG. 4C is an unscaled cross-sectional view taken along line 4C—4C of FIG. 4A.

The GCPW circuit 130 includes a dielectric substrate 132 having conductive patterns formed on both the top surface 132A and the bottom surface 132B. In this exemplary embodiment, the substrate is fabricated of aluminum nitride. The top conductor pattern is shown in FIG. 4A, and includes a conductor center trace 134 and top conductor groundplane 136, the center trace being separated by an open or clearout region 138 free of the conductive layer. The bottom conductor pattern is illustrated in FIG. 4B, and includes the bottom conductor groundplane 140 and circular pad 142, separated by clearout region 144. The top and bottom conductor groundplanes 136 and 140 are electrically connected together by plated through holes or vias 146.

The vertical RF interconnect 150 between the rectangular coaxial line 120 and the GCPW line 130 comprises a compressible center conductor 152. In this exemplary embodiment, the compressible center conductor is fabricated from a thin, gold plated, metal wire (usually tungsten or beryllium copper), which is wound up into a knitted, wire mesh cylinder. The wire mesh cylinder is captured within a dielectric body 154 in such a way as to form a 50 ohm, coaxial transmission line.

In this exemplary embodiment, the compressible center conductor 152 has an outer diameter of 0.040 inch. The dielectric 154 is made of TEFLON (TM), a moldable material with a dielectric constant of 2.1. The dielectric 152 has an inner diameter of 0.040 inch and an outer diameter of 0.120 inch. The compressible center conductor is inserted into the dielectric sleeve 154, forming a 50 ohm, coaxial transmission line. The dielectric sleeve 154 is captured within the housing metal structure, which also supplies the outer ground for the rectangular coaxial transmission line and the vertical interconnect coaxial transmission line.

When the dielectric sleeve 154 is inserted into the housing structure, it makes physical contact with the surface of the rectangular transmission line. The lower end of the compressible center conductor 152 makes electrical contact with the center conductor 122 of the rectangular coaxial line. In order to maximize the amount of contact between the compressible center conductor 152 and the pin 122, the center conductor pin 122 and dielectric sleeve 122 have been milled flat at the interface location with the vertical interconnect as shown in FIG. 3.

The upper end of the compressible center conductor 152 makes contact with a conductive sphere 148 attached to pad 142 of the GCPW line 130, where the RF signal is transitioned from a coaxial structure to a co-planar waveguide circuit. The sphere 148 ensures good compression of the conductor 152. The co-planar waveguide circuit can be terminated in a connector or connected to other circuitry.

Figure 5:
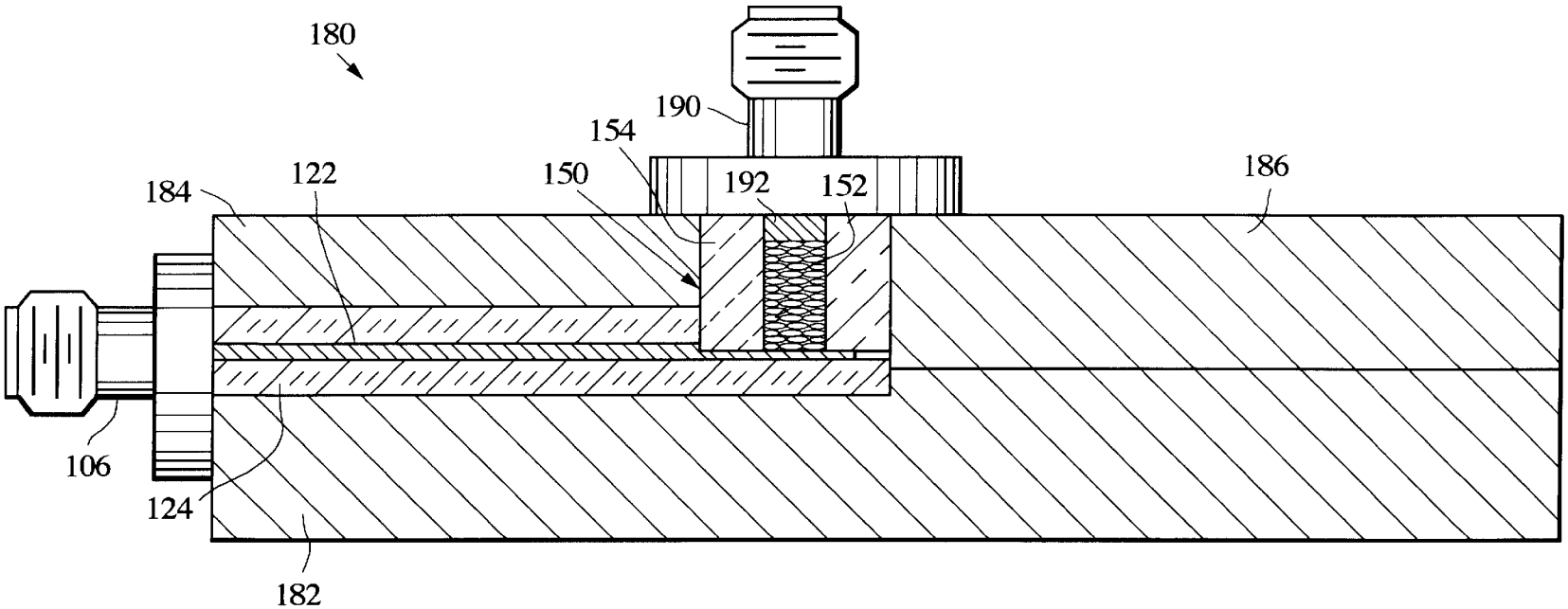
FIG. 5 is a side cross-sectional view illustrating an alternate embodiment, providing an interconnect between a rectangular coaxial line and a transverse coaxial line.

FIG. 5 illustrates an alternate embodiment of the invention, wherein an RF circuit 180 provides an interconnect 150 between a rectangular coaxial line and a transverse coaxial line. The rectangular transmission line 120 as in the embodiment of FIGS. 1–4 includes a center conductor 122 having a circular cross-section, and an outer dielectric sleeve 124 fabricated with a square or rectilinear cross-section. The circuit 180 includes a conductive housing structure comprising upper metal plates 184, 186 and a lower metal plate 182. The upper and lower plates sandwich the rectangular coaxial line 120, contacting the dielectric sleeve 124. A coaxial connector 106 is attached to the coaxial conductor 124 and to the housing structure.

A vertical coaxial connector 190 with center conductor 192 is positioned for entry of the vertical coaxial center conductor 192 through the opening formed in the upper plates 184, 186. The vertical RF interconnect 150 between the rectangular coaxial line 120 and the coaxial connector 190 comprises the compressible center conductor 152. In this exemplary embodiment, the compressible center conductor is fabricated from a thin, gold plated, metal wire (usually tungsten or beryllium copper), which is wound up into a knitted, wire mesh cylinder. The wire mesh cylinder is captured within the dielectric body 154 in such a way as to form a 50 ohm, coaxial transmission line. The pin 192 of the vertical coaxial connector has the same diameter as the diameter of the compressible center conductor 152 to maintain 50 ohm impedance when engaging the vertical interconnect. When the pin 192 is inserted into the dielectric sleeve 154 of the vertical interconnect, the pin 192 makes electrical contact with the top of the compressible center conductor 152 while the bottom end of the conductor 152 is pushed down to make electrical connection with the center conductor 122 of the rectangular coaxial line. The conductor 152 is compressed to take up physical variation in center conductor lengths.

Figure 6C:
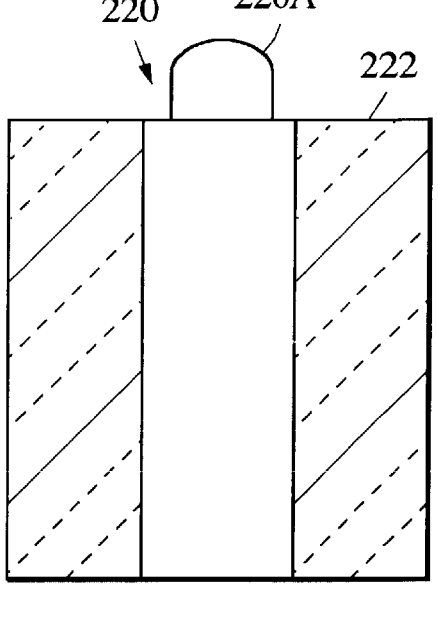
FIGS. 6A–6C illustrate three embodiments of the compressible conductor structure of an RF interconnect in accordance with the invention.
Figure 6B:
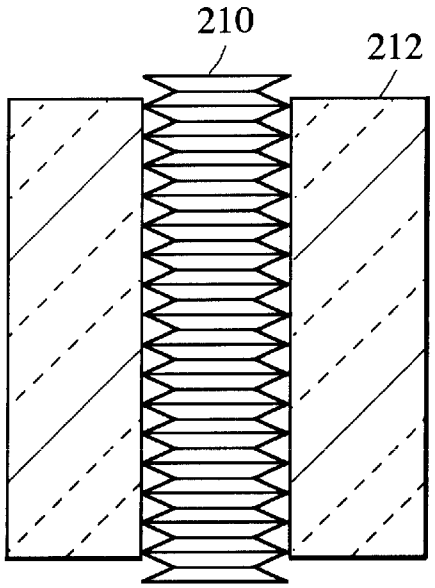
Figure 6A:
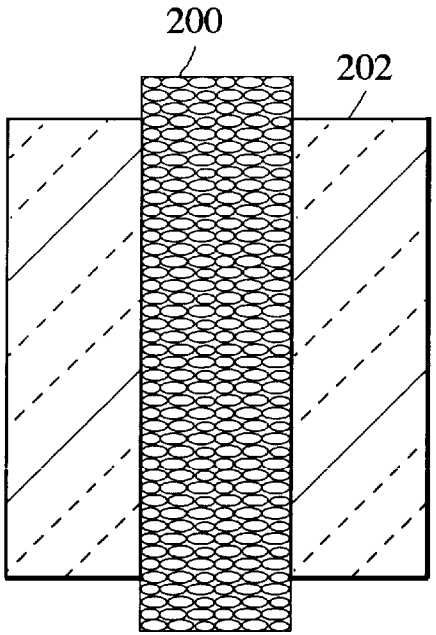

Three alternate types of compressible center conductors suitable for use in interconnect circuits embodying the invention are shown in FIGS. 6A–6C. FIG. 6A shows a compressible wire bundle 200 in a dielectric sleeve 202, and is the embodiment of compressible center conductor illustrated in the embodiments of FIGS. 1–5. FIG. 6B shows an electroformed bellow structure 210 in a dielectric sleeve 212; the bellows is compressible. FIG. 6C shows a "pogo pin" spring loaded structure 220 in a dielectric sleeve 222; the tip 220A is spring-biased to the extended position shown, but will retract under compressive force.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An RF interconnect between a rectangular coaxial transmission line including a coaxial center conductor and a dielectric structure with a rectilinear cross-sectional configuration fitted around the coaxial center conductor disposed in a first plane and an RF transmission line circuit vertically separated from the rectangular coaxial transmission line by a separation distance, the RF transmission line circuit including a transmission line conductor disposed in a second plane vertically separated from said coaxial center conductor and parallel to said first plane, the RF interconnect comprising:

a compressible conductor structure having an uncompressed length exceeding the separation distance;

a dielectric sleeve structure surrounding at least a portion of the uncompressed length of the compressible conductor structure;

and wherein said RF interconnect structure is disposed between said rectangular coaxial transmission line and said RF transmission line circuit such that said compressible conductor structure is placed under compression between said coaxial center conductor and said RF transmission line circuit to electrically connect said rectangular coaxial transmission line and said RF circuit through a first transverse interconnection between said rectangular coaxial transmission line and said RF interconnect structure and a second transverse interconnection between said RF interconnect structure and said RF transmission line circuit.

2. The RF interconnect of claim 1 wherein a first end of the compressible conductor structure is in contact with said RF transmission line circuit at a first contact area, a second end of the compressible conductor structure is in contact with the rectangular coaxial transmission line at a second contact area, and wherein the first and second contact areas are free of any permanent solder or epoxy material.

3. The RF interconnect of claim 1 wherein said RF transmission line circuit is a grounded coplanar waveguide (GCPW) circuit including a GCPW dielectric substrate with a first surface having said transmission line conductor and a ground conductor pattern formed thereon, said compressible conductor structure under compression between said GCPW circuit and said coaxial center conductor.

4. The RF interconnect of claim 3 wherein said GCPW substrate is parallel to the coaxial center conductor.

5. The RF interconnect of claim 3 wherein said GCPW dielectric substrate has a second surface having a conductor pad formed thereon and a conductive via extending between said conductor pad and said transmission line conductor on said first surface, said compressible conductor structure making electrical contact with said transmission line conductor through said conductor pad and said conductive via.

6. The RF interconnect of claim 5, wherein said RF circuit further includes a conductor sphere in contact with said conductor pad, and wherein the compressible conductor structure contacts said sphere.

7. The RF interconnect of claim 1 wherein the dielectric sleeve structure of the RF interconnect has a circular cross-sectional configuration, and wherein the dielectric structure of the rectangular coaxial line is relieved to form a region into which the dielectric sleeve structure is fitted.

8. The RF interconnect of claim 7 wherein the coaxial center conductor has a flat area formed therein at a contact point with the compressible conductor.

9. The RF interconnect of claim 1 wherein the compressible conductor structure includes a densely packed bundle of thin conductive wire.

10. The RF interconnect of claim 1 wherein the compressible conductor structure includes a compressible bellows structure.

11. The RF interconnect of claim 1 wherein the compressible conductor structure includes a spring-loaded retractable probe structure.

12. A method for forming an RF interconnect between a rectangular coaxial transmission line including a coaxial center conductor disposed in a first plane and a dielectric structure with a rectilinear cross-sectional configuration fitted around the coaxial center conductor and an RF transmission line circuit vertically separated from the rectangular coaxial transmission line by a separation distance, the RF transmission line circuit including a transmission line conductor disposed in a second plane vertically separated from said coaxial center conductor and parallel to said first plane, the method comprising:

providing a compressible conductor structure having an uncompressed length exceeding the separation distance, the compressible conductor structure in a dielectric sleeve structure surrounding at least a portion of the uncompressed length of the compressible conductor structure;

placing the RF interconnect structure between said coaxial center conductor of said rectangular coaxial transmission line and a conductor contact surface of said RF transmission line circuit such that the compressible conductor is placed under compression between the coaxial center conductor of said rectangular coaxial transmission line and the conductor contact surface of said RF transmission line circuit, to form a first transverse electrical interconnection between said coaxial center conductor of said rectangular coaxial transmission line and said compressible conductor structure, and a second transverse electrical interconection between said compressible conductor structure and said RF transmission line circuit.

13. The method of claim 12 wherein the RF circuit is a coaxial transmission line including a coaxial center conductor, and wherein the placing of the RF interconnect structure results in the compressible conductor structure extending transverse to the coaxial conductor of the rectangular coaxial transmission line, the compressible conductor under compression between the coaxial center conductor of the RF circuit and the coaxial center conductor of the rectangular coaxial transmission line.

14. The method of claim 12 wherein the RF transmission line circuit is a grounded coplanar waveguide (GCPW) circuit including a GCPW dielectric substrate with a first surface having a conductor center trace and a ground conductor pattern formed thereon, and wherein after said placing, the compressible conductor is under compression between the GCPW substrate and the rectangular coaxial transmission line.

15. The method of claim 14 wherein the GCPW substrate is parallel to the coaxial center conductor of the rectangular coaxial transmission line after said placing of the RF interconnect structure.

16. The method of claim 12 wherein a first end of the compressible conductor structure is in contact with said RF circuit at a first contact area after said placing, a second end of the compressible conductor structure is in contact with the rectangular coaxial transmission line at a second contact area after said placing, and wherein the first and second contact areas are free of any permanent solder or epoxy material.

* * * * *